US008571424B2

(12) United States Patent
Sugiyama et al.

(10) Patent No.: US 8,571,424 B2
(45) Date of Patent: Oct. 29, 2013

(54) IMAGE FORMING APPARATUS

(75) Inventors: Yuki Sugiyama, Numazu (JP); Takeshi Shimba, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 206 days.

(21) Appl. No.: 12/946,223

(22) Filed: Nov. 15, 2010

(65) Prior Publication Data

US 2011/0142458 A1 Jun. 16, 2011

(30) Foreign Application Priority Data

Dec. 14, 2009 (JP) ..... 2009-283462

(51) Int. Cl.
*G03G 15/00* (2006.01)

(52) U.S. Cl.
USPC ..... 399/8; 399/12; 399/40; 399/45; 399/66; 358/1.8; 358/1.9; 358/1.15; 358/1.16

(58) Field of Classification Search
USPC ..... 399/8, 43; 358/1.15
See application file for complete search history.

(56) References Cited

U.S. PATENT DOCUMENTS

| | | | | |
|---|---|---|---|---|
| 5,270,769 | A * | 12/1993 | Satoh et al. | 399/301 |
| 5,321,486 | A * | 6/1994 | Nanbu et al. | 399/14 |
| 6,731,890 | B1 * | 5/2004 | Rakov et al. | 399/66 |
| 7,532,353 | B2 * | 5/2009 | Murakami | 358/1.18 |
| 2003/0202221 | A1 * | 10/2003 | Motoi et al. | 358/474 |
| 2004/0091280 | A1 * | 5/2004 | Ono | 399/82 |
| 2005/0030591 | A1 * | 2/2005 | Murakami | 358/443 |
| 2008/0037079 | A1 * | 2/2008 | Harada | 358/498 |
| 2008/0273902 | A1 * | 11/2008 | Maeda | 399/301 |
| 2009/0015865 | A1 | 1/2009 | Tao | |
| 2010/0247121 | A1 * | 9/2010 | Shimba | 399/43 |

FOREIGN PATENT DOCUMENTS

| | | | |
|---|---|---|---|
| JP | 6-175514 | A | 6/1994 |
| JP | 2008-089647A | A | 4/2008 |
| JP | 2009-020313 | A | 1/2009 |
| JP | 2009-141526A | A | 6/2009 |
| JP | 2009-180806 | A | 8/2009 |
| JP | 2009-217145A | A | 9/2009 |

* cited by examiner

*Primary Examiner* — David Gray
*Assistant Examiner* — Francis Gray
(74) *Attorney, Agent, or Firm* — Canon USA Inc. IP Division

(57) ABSTRACT

An image forming apparatus that reduces a time period during which no image is formed due to a margin in leading end portion, by calculating the margin in leading end portion from position information of an image and moving forward output timing of a /TOP signal according to the margin in leading end portion.

6 Claims, 14 Drawing Sheets

IMAGE FORMING APPARATUS

BACKGROUND OF THE INVENTION

1. Field of the Invention

The present invention generally relates to image forming and, more particularly, to an image forming apparatus such as a copying machine and a printer of, for example, an electrophotographic method or an electrostatic storage method.

2. Description of the Related Art

When a color image is formed, an image forming apparatus of an electrophotographic method analyzes print information from an external apparatus, such as a computer, to rasterize image information contained in the print information into image information of each color of yellow, magenta, cyan, and black. Then, after a preparatory operation for image formation is performed based on the image information obtained from the image rasterization, the image forming apparatus successively forms a toner image on a photosensitive drum by toner of yellow, magenta, cyan, and black, and performs a multi-layer transfer of the toner images to an intermediate transfer body or a recording medium.

Thus, the time until an image is formed is affected by the time necessary for the preparatory operation for image formation. Therefore, Japanese Patent Application Laid-Open No. 6-175514 discusses a method for reducing the time necessary for the preparatory operation by controlling the timing to start the preparatory operation.

However, after the preparatory operation is performed, the timing for image formation is set to be able to start the image formation from a front end of the recording medium with reference to the size of a recording medium so that the image formation may be started from anywhere in the recording medium. Thus, there is an issue that if the sizes of recording media are the same, the time necessary for image formation barely changes regardless of whether an image is formed only in a front-end portion of the recording medium or an image is formed only in a backend portion of the recording medium.

SUMMARY OF THE INVENTION

The present invention is directed to an image forming apparatus capable of reducing time necessary for image formation by controlling timing to start image formation according to the size of an image to be formed.

According to an aspect of the present invention, an image forming apparatus includes a receiving unit for receiving image information, a sending unit for sending a request signal to receive the image information, an image forming unit for performing image formation based on the image information, and a control unit for controlling timing to send the request signal by the sending unit according to information about a margin of an image contained in the image information received by the receiving unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

However, exemplary embodiments below do not limit the invention to appended claims, and all combinations of features described in exemplary embodiments may not be absolutely necessary for solution of the invention.

Figure 1:
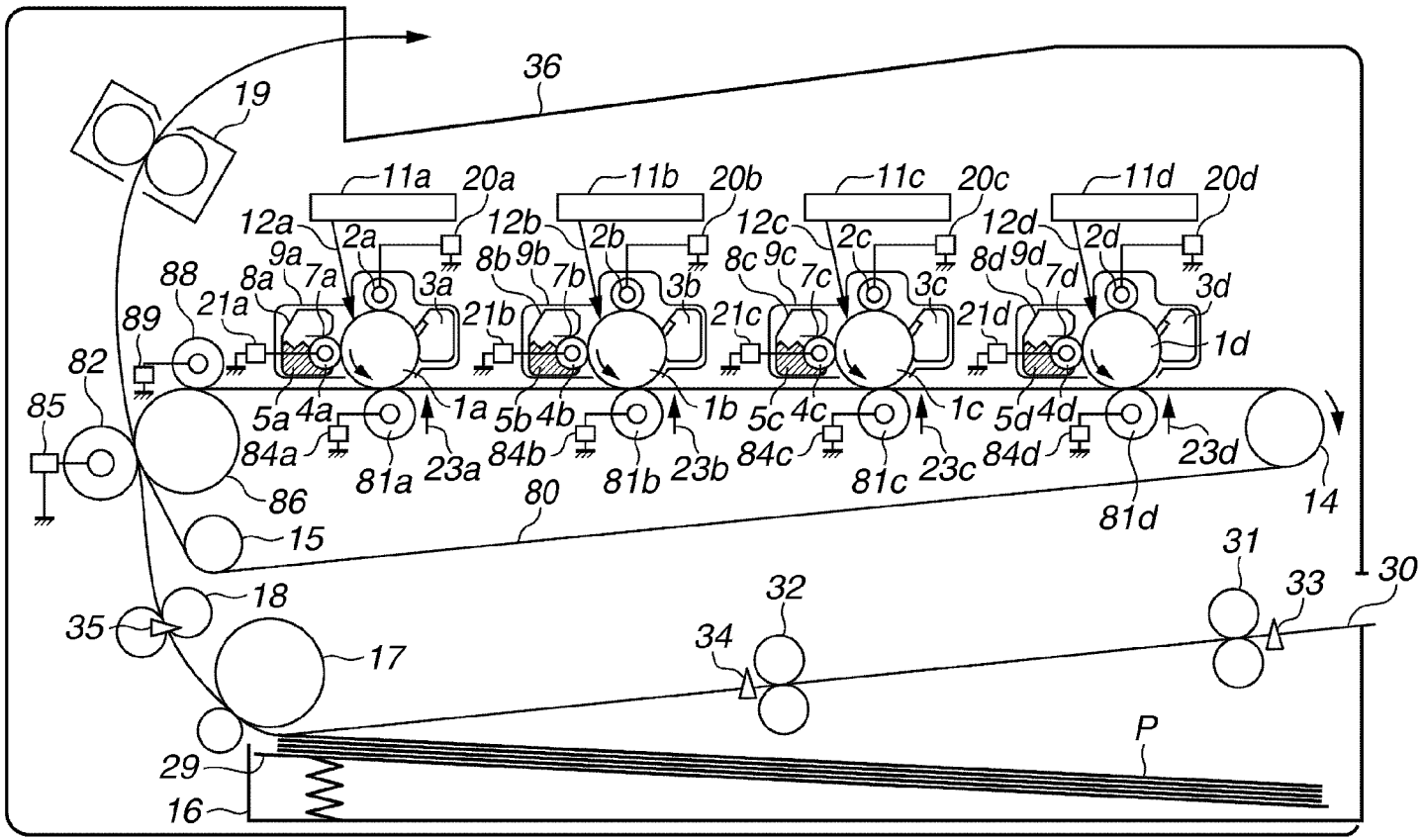
FIG. 1 is a sectional view illustrating a configuration of an image forming apparatus according to an exemplary embodiment of the present invention.

An overview of an overall configuration of a laser printer as an exemplary embodiment of an image forming apparatus in accordance with the present invention will be described with reference to FIG. 1. For description convenience, a configuration of only yellow will be described below, but a configuration for each color is similar and thus, not only configuration for yellow, but also for cyan, for magenta, and for black is similar.

(Image Formation and Primary Transfer)

A photosensitive drum 1*a* serves as an image bearing member. The photosensitive drum 1*a* is formed by laminating on a metal cylinder a plurality of functional organic materials composed of a carrier generation layer that generates charges by being exposed to light, a charge transport layer that transports generated charges. The outermost layer is almost insulated with low electrical conductivity. The photosensitive drum 1*a* is rotationally supported by a flange at both ends thereof. The photosensitive drum 1*a* is rotated counterclockwise in FIG. 1 by transmitting a driving force from a driving motor (not illustrated) to one end thereof.

A charging roller 2*a* serves as a charging unit. The charging roller 2*a* is brought into contact with the photosensitive drum 1*a* and uniformly charges the surface of the photosensitive drum 1*a* while driven by the rotation of the photosensitive drum 1*a*. A direct current (DC) voltage or DC voltage superposing an alternating current (AC) voltage thereon is applied to the charging roller 2*a*, and the photosensitive drum 1*a* is charged by an electrical discharge generated in a fine air gap positioned on the upper stream side and the down stream side of a contact nip portion, which is formed by the charging roller 2*a* and the surface of the photosensitive drum 1*a*.

A cleaning unit 3*a* cleans remaining toner on the photosensitive drum 1*a*. A developing roller 4*a* forms an image on the photosensitive drum 1*a* as a toner image. A developer 5*a* is a non-magnetic component to form an image. A developer coating blade 7*a* applies the developer 5*a* onto the developing roller 4*a*. The developing roller 4*a*, the developer 5*a*, and the developer coating blade 7*a* are integrally called a developer unit 8*a*.

A unit that puts together each member described heretofore is an integral-type process cartridge 9*a* that is removable from an image forming apparatus. Hereinafter, a component composed of a developing roller and a photosensitive drum is defined as an image forming station, and an image forming station that forms an image with yellow toner is defined as an image forming station 1 (or 1*st*).

Similarly, an image forming station that forms an image with magenta toner is defined as an image forming station 2 (or 2*st*), an image forming station that forms an image with cyan toner as an image forming station 3 (or 3*st*), and an image forming station that forms an image with black toner as an image forming station 4 (or 4*st*).

An exposure unit 11*a* exposes the photosensitive drum 1*a* to light. The exposure unit 11*a* includes a scanner unit that scans a laser light using a polygon mirror or a light emitting diode (LED) array, and irradiates a scanning beam 12*a* modulated based on an image signal. A charging bias power supply 20*a* applies a bias voltage to the charging roller 2*a*. A development bias power supply 21*a* applies a bias to the developing roller 4*a*. A primary transfer bias power supply 84*a* applies a bias to a primary transfer roller 81*a*.

An intermediate transfer belt 80 is supported by three rollers of a secondary transfer counter roller 86, a driving roller 14, and a tension roller 15 as stretching members thereof so that an appropriate tension of the intermediate transfer belt 80 is maintained thereby. By driving the driving roller 14, the intermediate transfer belt 80 moves at a predetermined speed in the direction from the photosensitive drum 1*a* to a photosensitive drum 1*d*.

The primary transfer roller 81*a* is arranged at a position opposite to the photosensitive drum 1*a*. The primary transfer roller 81*a* is connected to the primary transfer bias power supply 84*a*, and an image on the photosensitive drum 1*a* is transferred to the intermediate transfer belt 80.

By repeating this operation for each color, an image in each color is transferred to the intermediate transfer belt 80 to form a multi-color image. A neutralization member 23*a* is arranged on the downstream of the rotation direction of the intermediate transfer belt 80 of the primary transfer roller 81*a*. The driving roller 14, the tension roller 15, the neutralization member 23*a*, and the secondary transfer counter roller 86 are electrically grounded.

(Recording Medium Feeding)

When a recording medium P is fed from a main body cassette 16, a main body cassette base plate 29 is lifted by driving a cassette pickup roller 17 so that the recording medium P loaded inside the main body cassette 16 is pushed up. The pushed-up recording medium P comes into contact with the cassette pickup roller 17. The recording medium P is fed one by one after being separated with the rotation of the cassette pickup roller 17, and is conveyed to a registration roller 18.

When a recording medium P is fed from a manual tray 30, a recording medium presence sensor 33 detects that the recording medium P is set at the manual tray 30. If the recording medium P is set at the manual tray 30, feeding of the recording medium P is started by a manual tray guiding roller 31.

Then, the recording medium P is conveyed to immediately below the cassette pickup roller 17. When the front end of the recording medium P conveyed from the manual tray 30 arrives immediately below the cassette pickup roller 17, the recording medium P conveyed from the manual tray 30 is conveyed to the registration roller 18 by driving the cassette pickup roller 17.

(Secondary Transfer)

The recording medium P conveyed to the registration roller 18 is conveyed to a secondary transfer unit by the registration roller 18. An image formed on the intermediate transfer belt 80 is conveyed to a contact portion, that is, a secondary transfer position, between a secondary transfer roller 82 and the intermediate transfer belt 80. An electric field is formed by the secondary transfer roller 82 and the secondary transfer counter roller 86 so that the image on the intermediate transfer belt 80 is secondarily transferred to the recording medium P. The recording medium P to which the image is transferred is conveyed to a fixing unit 19.

(Fixing)

The fixing unit 19 is used to fix an image by applying heat and pressure to the image on the recording medium P, and has a fixing belt (not illustrated) and elastic pressure rollers (not illustrated). The elastic pressure rollers sandwich the fixing belt and form a fixing nip portion having a predetermined width with predetermined contact pressure, with a belt guide member (not illustrated).

In a heat-adjusted state after the temperature of the fixing nip portion rises to a predetermined temperature, the recording medium P is conveyed with the image surface directed upward between the fixing belt and the elastic pressure roller of the fixing nip portion, that is, facing to the fixing belt surface, and then fixed by the fixing nip portion. The fixed recording medium P is discharged to a discharge tray 36.

Figure 2:
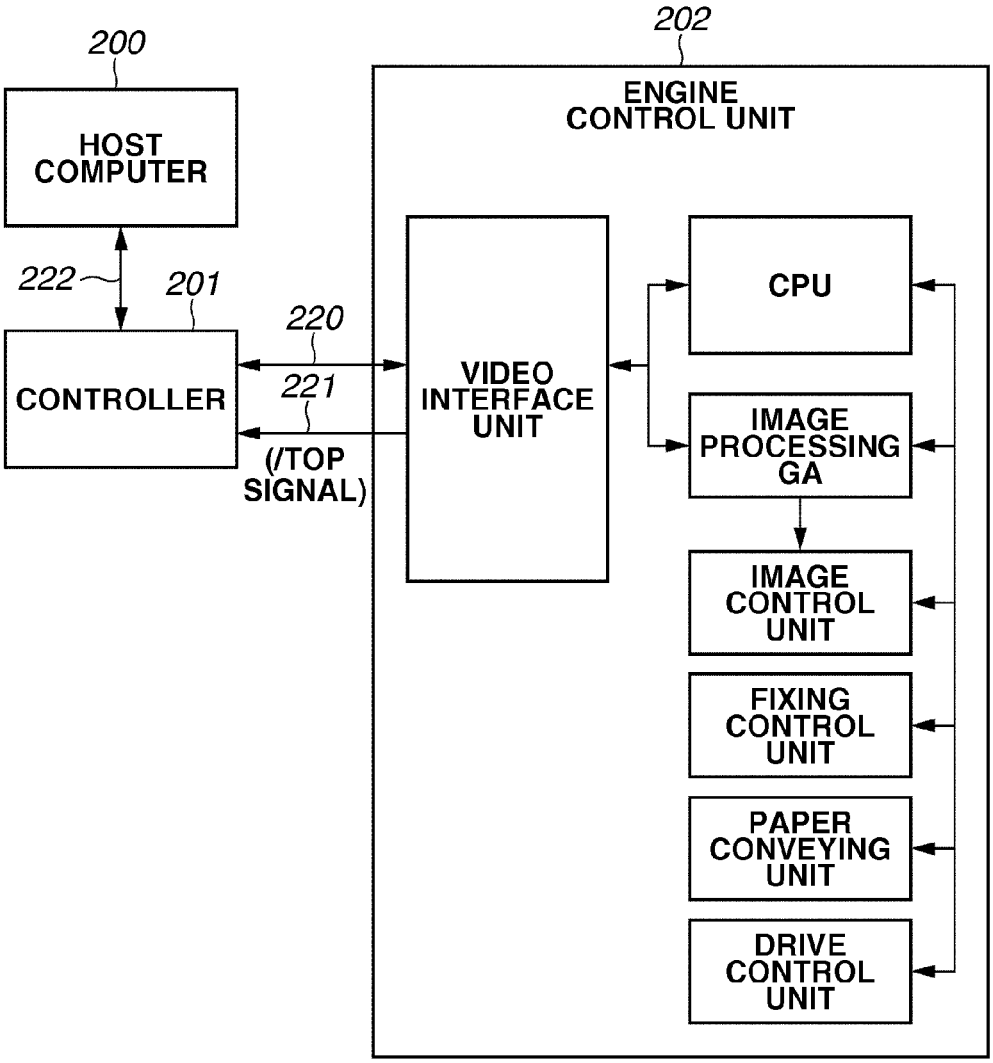
FIG. 2 is a block diagram illustrating control of the image forming apparatus according to an exemplary embodiment of the present invention.

FIG. 2 is a block diagram exemplifying the system configuration of a color image forming apparatus in accordance with an exemplary embodiment of the present invention. A host computer 200 sends print data (such as character code, figure data, image data, and process conditions) described in a page description language such as PCL (Printer Control Language) to a controller 201.

The controller 201 can mutually communicate with the host computer 200 and an engine control unit 202. The controller 201 receives image information and print instructions from the host computer 200, and analyzes the received image information to convert the image information into bit data. Then, the controller 201 sends a reservation command, which includes reservation information, print start command(s), and/or video signal(s), to the engine control unit 202 for each of the recording media P.

The controller 201 sends the reservation command to the engine control unit 202 according to print instructions from the host computer 200, and sends, in the timing when the color image forming apparatus becomes ready for printing, the print start command to the engine control unit 202.

The engine control unit 202 makes execution preparations for printing in order of the reservation command received from the controller 201, and waits for the print start command from the controller 201. When print instructions are received, the engine control unit 202 sends /TOP signals Y, M, C, and K, which are request signals serving as the reference timing of the video signal output of each color, to the controller 201 to start a printing operation according to the information of the reservation command.

The controller 201 may include the host computer 200, an interface to the engine control unit 202, a processor, a memory, and the like.

Figure 3:
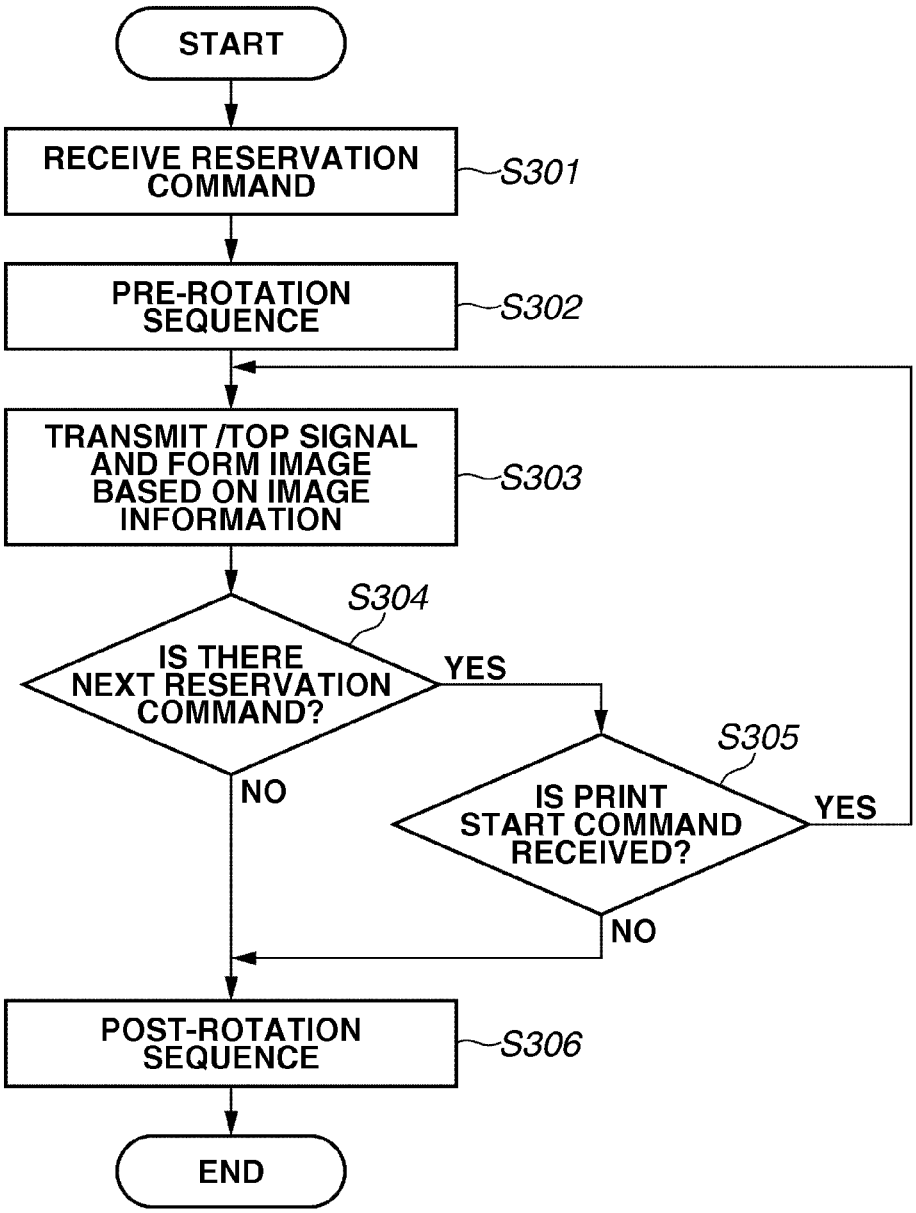
FIG. 3 is a flow chart illustrating a printing operation.

FIG. 3 is a flow chart illustrating a printing operation. Prior to image formation, the controller 201 first sends the reservation command to the engine control unit 202. The reservation command contains information about the order of image information to be sent and the size of the recording medium P. After the reservation command is sent, the print start command is sent to the engine control unit 202 to form an image with the reserved content.

In step S301, after receiving the reservation command, the engine control unit 202 waits for reception of the print start command. When the engine control unit 202 receives the print start command, in step S302, the engine control unit 202 performs pre-processing (hereinafter, called a "pre-rotation sequence") to perform a printing operation.

In step S303, after the pre-rotation sequence is completed, the engine control unit 202 outputs a /TOP signal to start image formation according to the first piece of image information. The /TOP signal corresponds to a vertical synchronizing signal between the controller 201 and the engine control unit 202, and serves as a trigger to send image information for each page from the controller 201 to the engine control unit 202.

In step S304, the engine control unit 202 determines whether to receive the next reservation command before the next printing operation start timing (hereinafter, called "normal print start timing") to maintain throughput. If received (YES in step S304), in step S305, the engine control unit 202 waits for reception of the print start command. When the print start command is received (YES in step S305), the processing proceeds to step S303. If no command is received in step S304 or S305 (NO in step S304 or S305), in step S306, the engine control unit 202 performs post-processing (hereinafter, called a "post-rotation sequence") of the image formation.

Figure 4A:
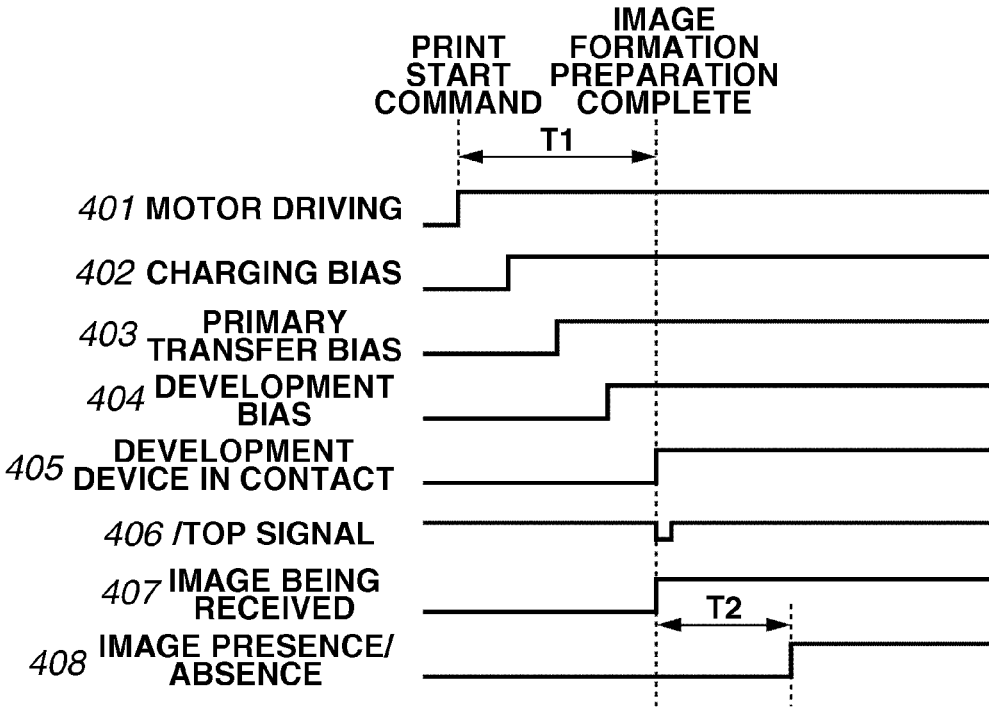
FIGS. 4A and 4B are timing charts illustrating output timing of a pre-rotation sequence and a /TOP signal.
Figure 4B:
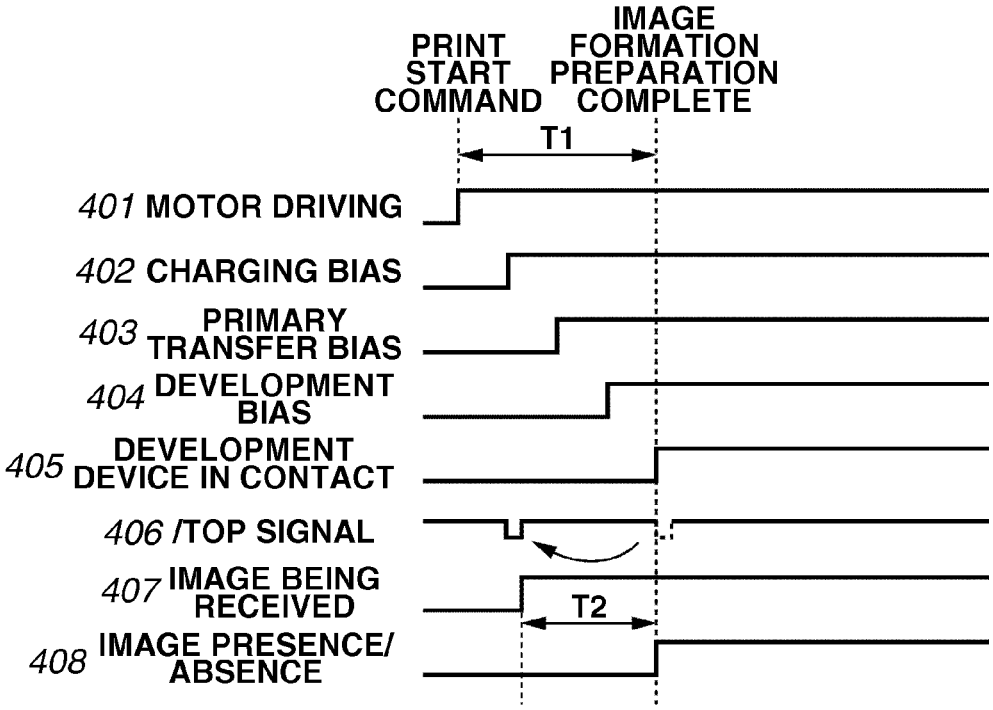

FIGS. 4A and 4B are timing charts illustrating output timing of a pre-rotation sequence and a /TOP signal by the engine control unit 202. FIG. 4A illustrates a conventional timing chart and FIG. 4B illustrates a timing chart according to the present exemplary embodiment.

In FIG. 4A, driving of a plurality of motors to rotate the intermediate transfer belt 80, the photosensitive drum 1*a*, the scanner unit, the fixing belt and the like (401), output of a bias to charge the photosensitive drum 1*a* (402), output of a primary transfer bias to transfer image to be developed on the photosensitive drum 1*a* to the intermediate transfer belt 80 (403), output of a bias to develop a latent image on the photosensitive drum 1*a* (404), and processing to bring the developing roller 4*a* into contact with the photosensitive drum 1*a* (405) are successively carried out to start an image formation operation in the pre-rotation sequence.

Thus, a predetermined time (T1) is needed before preparations to start image formation are completed to output the /TOP signal. Therefore, the time for the pre-rotation sequence is one of major factors to determine the image formation time.

A time T2 is a time between reception of image information and an actual start of rendering, and varies depending on a margin in a leading end portion of an image. The time T2 in which actual image rendering is not started due to a margin portion, though preparations for image formation are completed, is a loss time for image formation.

On the other hand, in FIG. 4B, the /TOP signal is sent earlier by the time T2, which corresponds to the time between reception of image information and an actual start of rendering. Accordingly, preparations for image formation and image reception can be performed in parallel so that the image formation can be started immediately after the preparation for image formation is completed by minimizing a time lag between preparation for image formation and image reception.

Though not illustrated, to prevent an image from not being formed at a predetermined position of the recording medium due to forwarded sending of the /TOP signal, the feeding timing of the recording medium is also moved forward according to the /TOP signal if feeding of the recording medium cannot be performed in time for the forwarded /TOP signal.

By moving the feeding timing forward according to the /TOP signal, it becomes possible to minimize a time lag and also to form an image at a predetermined position of the recording medium. If there is a sufficient lead time for the recording medium, control is performed so that the recording medium is caused to wait at the registration roller 18 and then to restart to convey the recording medium in time for the image formation, which will be described below.

Figure 5:
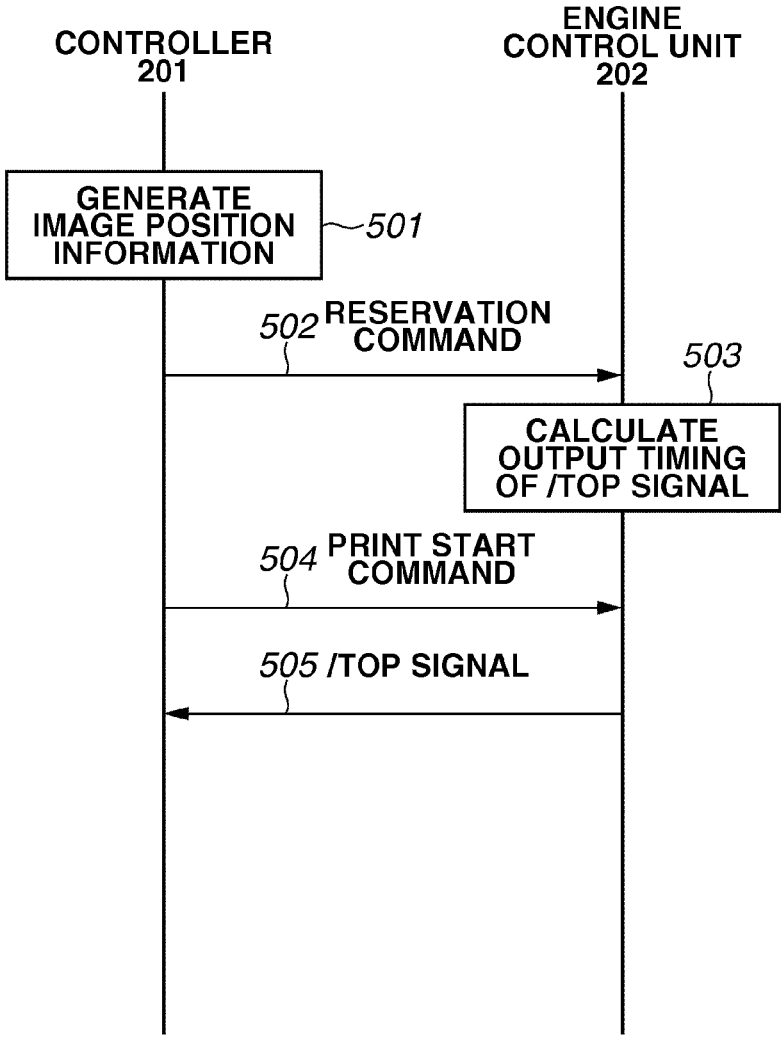
FIG. 5 illustrates a communication sequence between a controller and an engine control unit according to a first exemplary embodiment.

A communication sequence between the controller 201 and the engine control unit 202 according to the present exemplary embodiment will be described with reference to FIG. 5. To form an image by an image forming apparatus, the controller 201 rasterizes image information to generate position information indicating where in the recording medium P to form an image (501). The controller 201 sends the generated position information to the engine control unit 202 together with the first reservation command (502).

Figure 6:
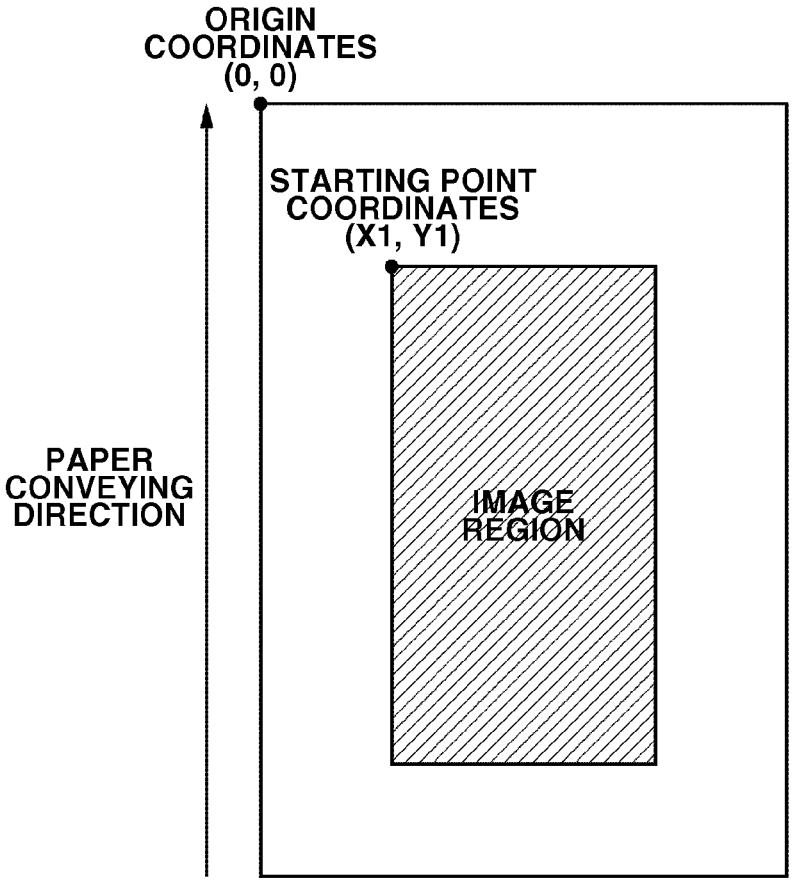
FIG. 6 illustrates position information of an image according to the first exemplary embodiment.

Position information of an image generated by the controller 201 will be described with reference to FIG. 6. The controller 201 generates position information of an image by setting coordinates as starting point coordinates where rendering of the image using the front end of the recording medium P as an origin is started. In FIG. 6, the starting point coordinates are (X1, Y1). It is found from this that a region of the distance Y1 from the front end of the recording medium P is a margin portion where no image is formed.

The engine control unit 202 acquires coordinates where image formation starts from the received reservation command, and calculates a time until the /TOP signal is output based on the size of a margin in leading end portion calculated from the coordinates (603). Details of the calculation method for calculating a time before the /TOP signal is output will be described below.

Then, with the print start command being sent from the controller 201 to the engine control unit 202 (604), the engine control unit 202 starts the pre-rotation sequence, and outputs the first /TOP signal in the timing calculated in 603.

Figure 7:
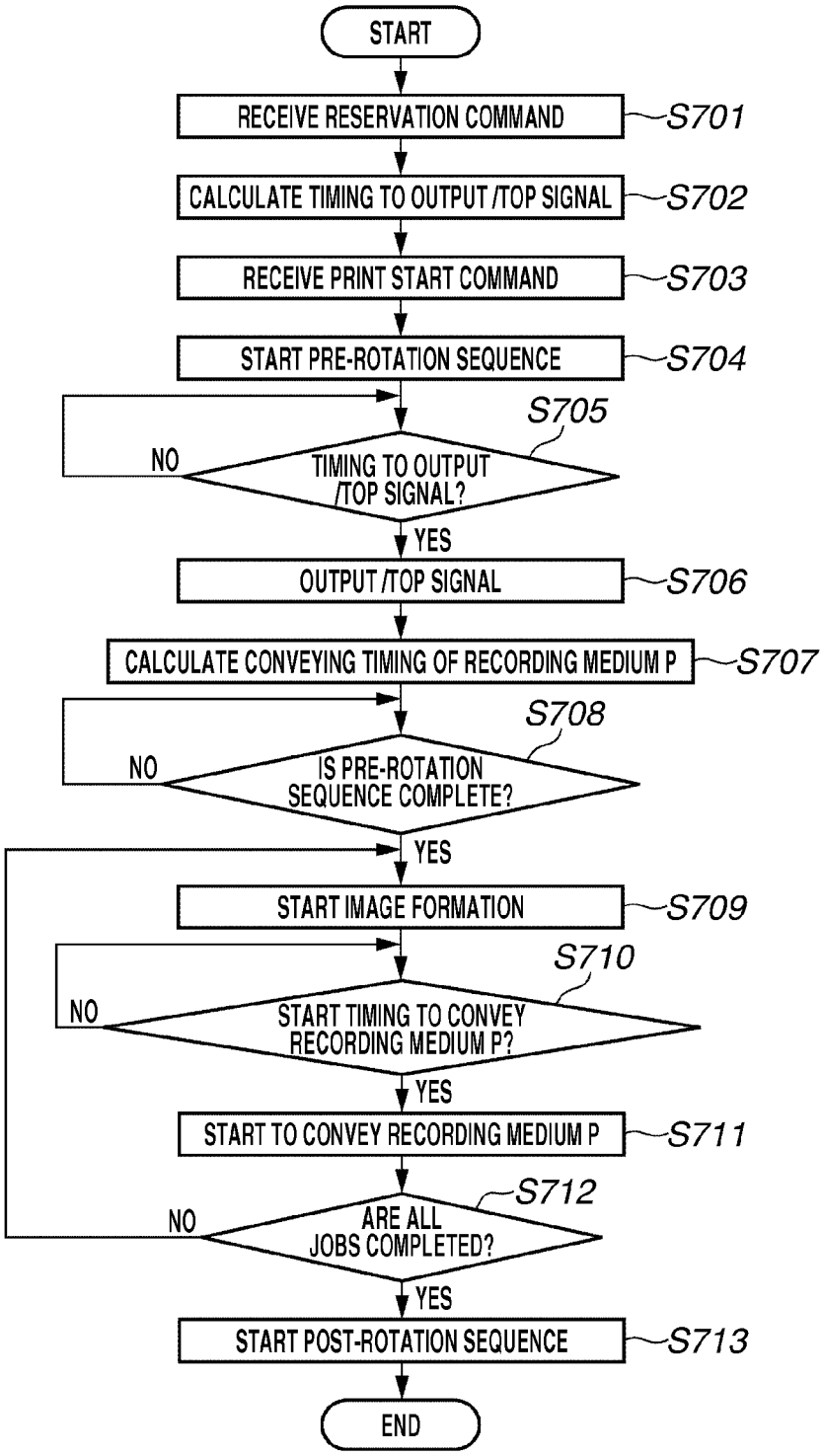
FIG. 7 is a flow chart illustrating a flow from the start of image formation to the end thereof in the first exemplary embodiment.

The flow from the start of image formation to the end thereof in the present exemplary embodiment will be described with reference to the flow chart in FIG. 7. In step S701, the engine control unit 202 receives the reservation command. In step S702, the engine control unit 202 determines a time between the start of the pre-rotation sequence and output of the /TOP signal by using the margin in leading end portion size and the printing speed. A calculation formula is as shown below.

If the relation of the time T1 necessary for the pre-rotation sequence>the time T2 in which no image is actually formed due to a margin portion holds, the calculation formula is given by Formula (1).

Time between the start of the pre-rotation sequence and output of the /*TOP* signal=time after the start of the pre-rotation sequence before an image becomes formable−(conveying direction distance *Y*1 of the margin in leading end portion/printing speed) (1)

If, for example, the printing speed is 115.5 mm/sec and the margin in leading end portion is 100 mm, the time necessary for conveying through the margin in leading end portion of 100 mm becomes 866 ms and if the time after the start of the pre-rotation sequence before a normal /TOP signal is ready to be output is 4743 ms, the /TOP signal can be output in 3877 ms (=4743−866) from Formula (1).

Accordingly, the image formation time is reduced by the conveying time through the margin in leading end portion, that is, 866 ms. The time between output of the /TOP signal and the end of image formation is determined by the size of the recording medium, the conveying distance, and the printing speed and thus, the reduced time also changes when these conditions change.

If the relation of the time T1 necessary for the pre-rotation sequence>the time T2 in which no image is actually formed due to a margin portion, does not hold, the calculation formula is given by Formula (2).

Time between the start of the pre-rotation sequence and output of the /*TOP* signal=0 (2)

In step S703, after calculating the time between the start of the pre-rotation sequence and output of the /TOP signal, the engine control unit 202 receives the print start command. In step S704, the engine control unit 202 starts the pre-rotation sequence.

In the pre-rotation sequence, motors are driven to rotate the intermediate transfer belt 80 and the photosensitive drum 1*a*, a bias to charge the photosensitive drum 1*a* is applied, a bias to supply toner to the developing roller 4*a* is applied, and the developing roller 4*a* is brought into contact with the photosensitive drum 1*a*.

In step S705, the engine control unit 202 monitors whether the timing to output the /TOP signal calculated in step S702 comes while the pre-rotation sequence is carried out. In step S706, when the time calculated in step S702 comes (YES in step S705), the engine control unit 202 outputs the /TOP signal and receives image information from the controller 201.

In step S707, the engine control unit 202 calculates the start timing to convey the recording medium P nipped by the registration roller 18. A calculation formula to calculate the start timing to convey is as shown below in Formula (3).

Time between output of the /*TOP* signal and the start of conveying the recording medium *P*=time to convey through a distance (*Limg*) from the first laser irradiation position to the secondary transfer unit−time to convey through a distance (*Lpap*) from the registration roller 18 to the secondary transfer unit (3)

In step S708, the engine control unit 202 checks whether the pre-rotation sequence is completed and when the pre-rotation sequence is completed (YES in step S708), in step S709, the engine control unit 202 starts image formation. Since the /TOP signal is output before the pre-rotation sequence is completed, the image formation can be started based on image information received from the controller 201 by reducing a time in which no image is formed due to a margin in leading end portion.

When, in step S710, the start timing to convey the recording medium P comes (YES in step S710), in step S711, the engine control unit 202 starts to convey the recording medium P that is waiting at the registration roller 18. When, in step S712, the image formation of all jobs is completed (YES in step S712), in step S713, the engine control unit 202 carries out the post-rotation sequence. In the post-rotation sequence, an image formed on the intermediate transfer belt 80 is secondarily transferred, the intermediate transfer belt 80 is cleaned and then, processing to turn off applied biases and motor driving for image formation is performed.

Thus, by moving forward the timing to output the /TOP signal based on the margin in leading end portion of an image to be formed while the pre-rotation sequence is carried out, the timing to receive image information is also moved forward. Accordingly, the time before the start of image formation after the pre-rotation sequence is completed, can be reduced. As a result, the time necessary for image formation can be reduced compared with the conventional control in which the /TOP signal is output after the pre-rotation sequence is completed.

In the present exemplary embodiment, a case where position information of an image formed simultaneously with the reservation command is sent, has been described, the present exemplary embodiment is not limited to this. For example, a special command to send position information of an image may be used to send the position information in the timing before or after the reservation command or the transmission timing to send position information together with the print start command may be adopted.

In a second exemplary embodiment, not only the timing to output the /TOP signal is controlled according to the margin in leading end portion of an image, but also the start timing of the post-rotation sequence is controlled according to a trailing end margin of the image. The description of the configurations similar to those of the first exemplary embodiment is omitted.

Figure 8:
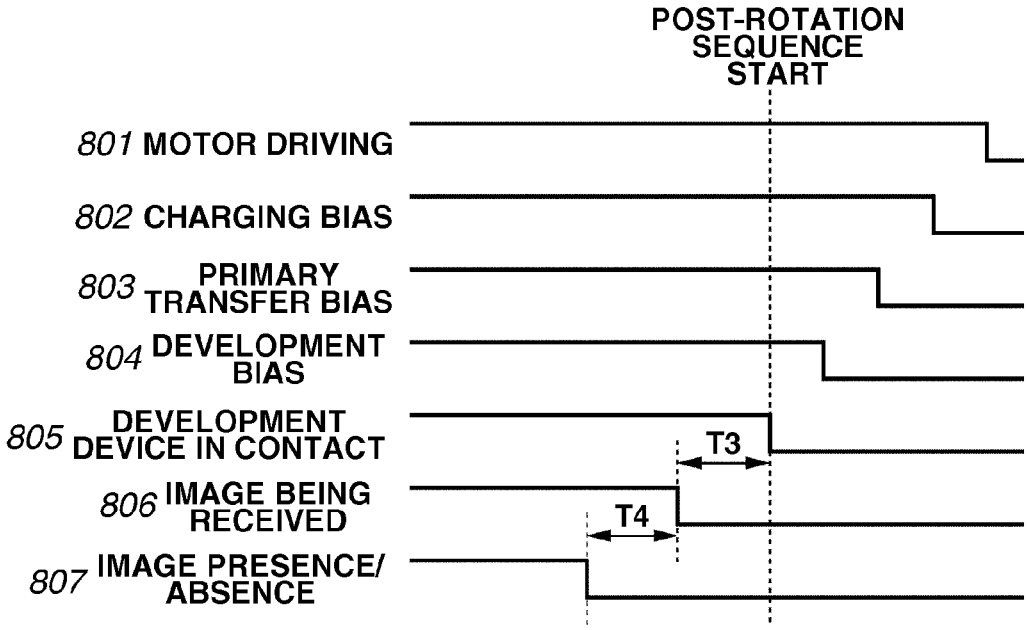
FIG. 8 is a timing chart illustrating timing of a post-rotation sequence.

FIG. 8 is a timing chart illustrating the timing of the post-rotation sequence by the engine control unit 202. In the post-rotation sequence, after the image formation operation is completed, operations to stop driving of the plurality of motors to rotate the intermediate transfer belt 80, the photosensitive drum 1*a*, the scanner unit, the fixing belt (401), to stop output of a bias to charge the photosensitive drum 1*a* (402), to stop output of a primary transfer bias to transfer an image to be developed on the photosensitive drum 1*a* to the intermediate transfer belt 80 (403), to stop output of a bias to develop a latent image on the photosensitive drum 1*a* (404), and processing to separate the developing roller 4*a* from the photosensitive drum 1*a* (405) are successively carried out.

The post-rotation sequence is started when a predetermined time has passed after the image formation is completed. Thus, for an image having a trailing end margin, for example, a time (T3) between the end of reception of image information and the start of the post-rotation sequence and a time (T4) for a margin after the image formation is completed, are generated.

Figure 9:
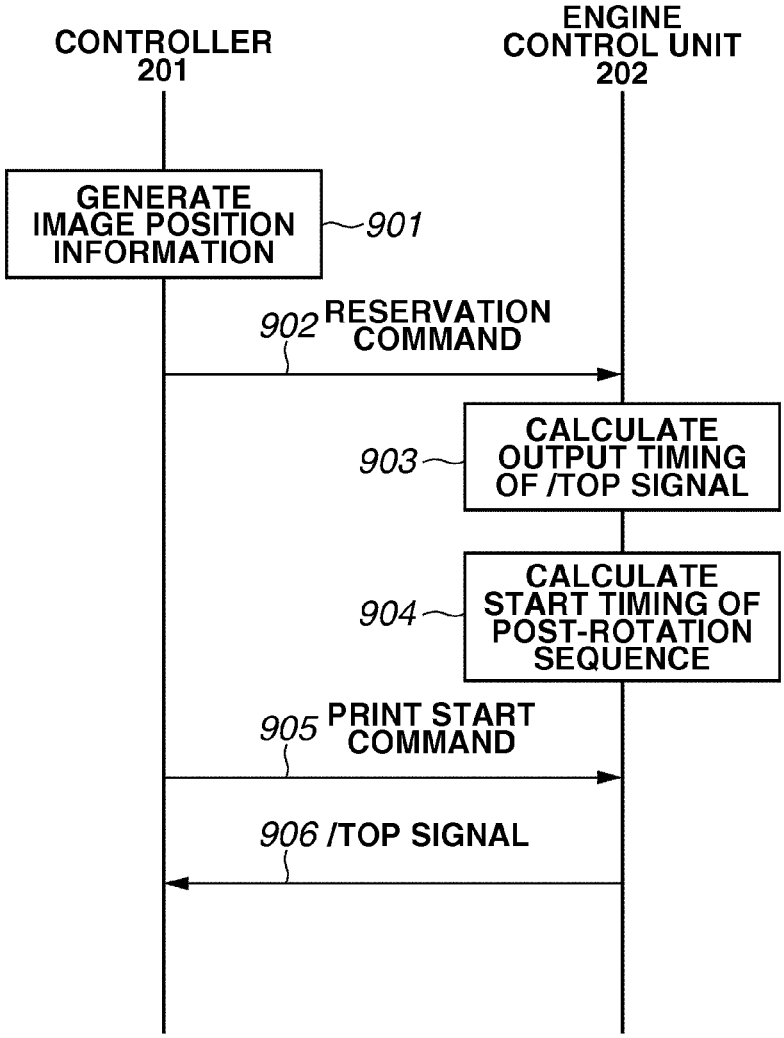
FIG. 9 illustrates a communication sequence between the controller and the engine control unit in a second exemplary embodiment.

The communication sequence between the controller 201 and the engine control unit 202 according to the present exemplary embodiment will be described with reference to FIG. 9. The controller 201 generates position information of an image (901), and sends the position information to the engine control unit 202 together with the first reservation command.

Position information of an image generated by the controller 201 will be described with reference to FIG. 10. The controller 201 generates position information of an image by setting coordinates as starting point coordinates where rendering of the image, and coordinates as end coordinates where rendering of the image is completed.

Figure 10:
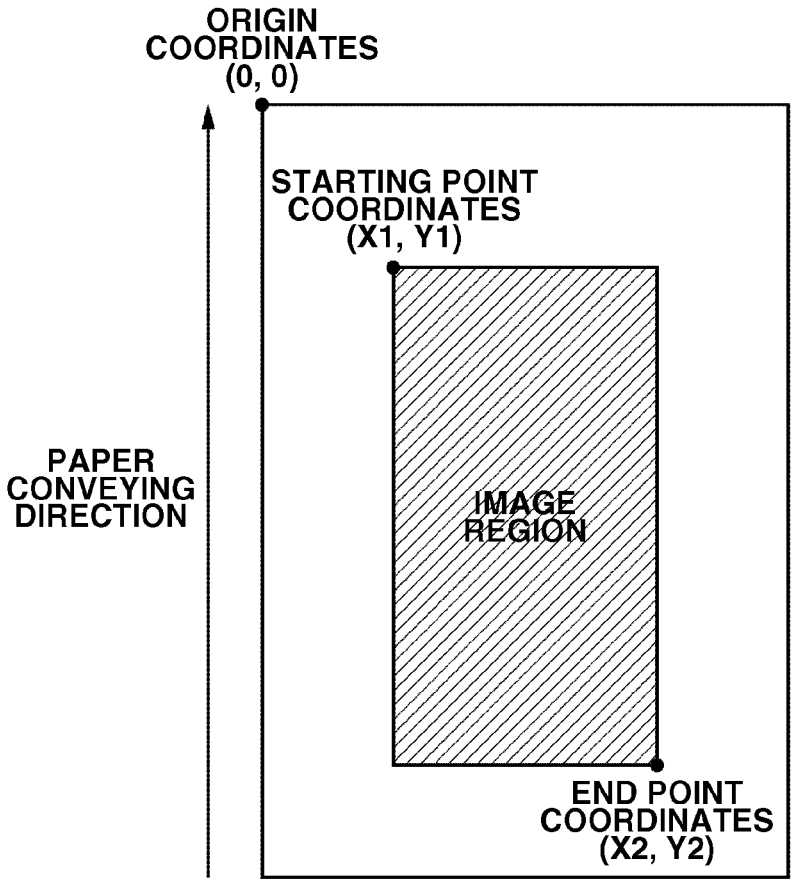
FIG. 10 illustrates position information of the image according to the second exemplary embodiment.

In FIG. 10, the starting point coordinates are (X1, Y1), and the end coordinates are (X2, Y2). It is recognized from this that a region of the distance Y1 from the front end of the recording medium P is a margin portion where no image is formed and also a region of the distance Y2 up to the trailing end after rendering is completed is a margin portion where no image is formed.

The engine control unit 202 acquires coordinates where image formation starts from the received reservation command, and calculates a time until the /TOP signal is output based on the size of a margin in leading end portion calculated from the coordinates (903). The engine control unit 202 also acquires coordinates where image formation ends from the received reservation command, and calculates a time when the post-rotation sequence is started based on the size of a trailing end margin calculated from the coordinates (904).

Figure 11:
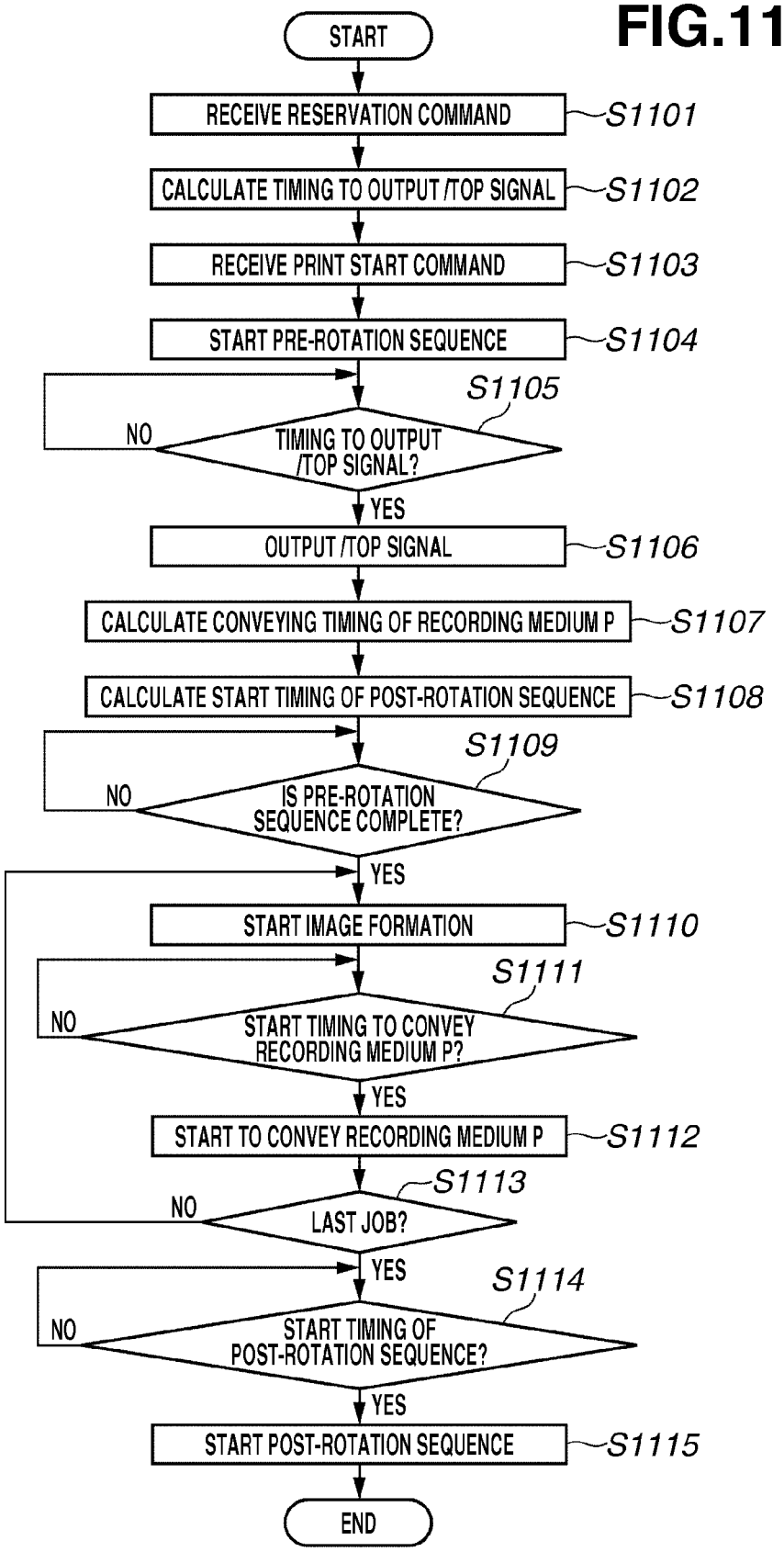
FIG. 11 is a flow chart illustrating a flow from the start of image formation to the end thereof according to the second exemplary embodiment.

The flow from the start of image formation to the end thereof in the present exemplary embodiment will be described referring to the flow chart in FIG. 11. The description of the sequence similar to that in the first exemplary embodiment is omitted.

Steps S1101 to S1107 are the same as steps S701 to S707 and thus, the description thereof is omitted.

In step S1108, the engine control unit 202 determines a time between output of the /TOP signal and the completion of image formation by using the size of the recording medium P obtained from the reservation command, coordinates where the image formation ends, and the printing speed. When output of image data is completed and the trailing end of the image on the intermediate transfer belt 80 passes immediately below 4*st*, the post-rotation sequence becomes executable.

A concrete calculation formula for the start timing of the post-rotation sequence is as shown below in Formula (4).

Time between output of the /*TOP* signal and the start of the post-rotation sequence=(conveying distance from the front end of the recording medium *P* to coordinates where image formation ends+conveying distance from the laser irradiation position of 1*st* to the contact point with the intermediate transfer belt 80)/printing speed (4)

If, for example, the printing speed is 115.5 mm/sec and the trailing end margin is 100 mm, the time necessary for conveying through the trailing end margin of 100 mm becomes 866 ms. Assuming that the size (sub-scanning direction) of the recording medium is 297 mm and that of the margin in leading end portion is 0 mm, if the conveying distance from the laser irradiation position of 1*st* to the contact point with the intermediate transfer belt 80 is 36.1 mm, and the conveying distance from the contact point of 1*st* with the intermediate transfer belt 80 to the contact point of 4*st* with the intermediate transfer belt 80 is 234 mm, the time between output of the /TOP signal and the start of the post-rotation sequence is obtained from Formula (3) as (36.1+234+(297−100))/115.5×1000=4044 ms.

If the trailing end margin is not considered, the time between output of the /TOP signal and the start of the post-rotation sequence is obtained from Formula (3) as (36.1+234+297)/115.5×1000=4910 ms.

Thus, compared with a case where the trailing end margin is 0 mm, the time up to the start of the post-rotation sequence is moved forward by 866 ms. That is, the image formation time is reduced by 866 ms by which the start timing of the post-rotation sequence is moved forward due to the trailing end margin.

By combining the control of the pre-rotation sequence described in the first exemplary embodiment and that of the post-rotation sequence described in the present exemplary embodiment, the image formation time can be reduced for each of the margin in leading end portion and the trailing end margin of an image.

Steps S1109 to S1112 are the same as steps S708 to S711 and thus, the description thereof is omitted. In step S1113, the engine control unit 202 determines whether the current image formation is the last job. On the other hand, if the current image formation is not the last job (NO in step S1113), the processing returns to step S1110 to continue the image formation. If the current image formation is the last job (YES in step S1113), in step S1114, the engine control unit 202 determines whether the timing is the start timing of the post-rotation sequence calculated in step S1108. If the timing is the start timing of the post-rotation sequence (YES in step S1114), in step S1115, the engine control unit 202 starts the post-rotation sequence.

Thus, by moving forward the timing to start the post-rotation sequence based on the trailing end margin of an image to be formed, the necessary time between the start of the pre-rotation sequence and the end of the post-rotation sequence can be reduced. Therefore, even in a case where the next job is received during execution of the post-rotation sequence, the start timing of printing of the next job can be moved forward because the post-rotation sequence is started earlier than when normally controlled.

In the present exemplary embodiment, the method for controlling the timing of the post-rotation sequence by using the trailing end margin has been described, but the present exemplary embodiment is not limited to this. For example, the timing to apply a development bias may be controlled by the timing calculated from the trailing end margin. When the development bias is controlled, based on Formula (4), the timing can be calculated as shown below in Formula (5). Further, a connection sequence for continuous printing such as controlling the timing to change to the color mode may be controlled.

Time after output of the /*TOP* signal until the development bias is turned off=(conveying distance from the front end of the recording medium *P* to coordinates where image formation ends+conveying distance from the laser irradiation position of 1*st* to the contact point with the developing roller 4*a*)/printing speed (5)

In a third exemplary embodiment, a method for reducing the time up to image formation by receiving image information (margin in leading end portion) of each color, calculating the timing to render a video signal (image front end excluding a margin) of each color, and calculating a forwarded time of a /TOP signal. The description of the configurations similar to those of the first exemplary embodiment is omitted.

Figure 12:
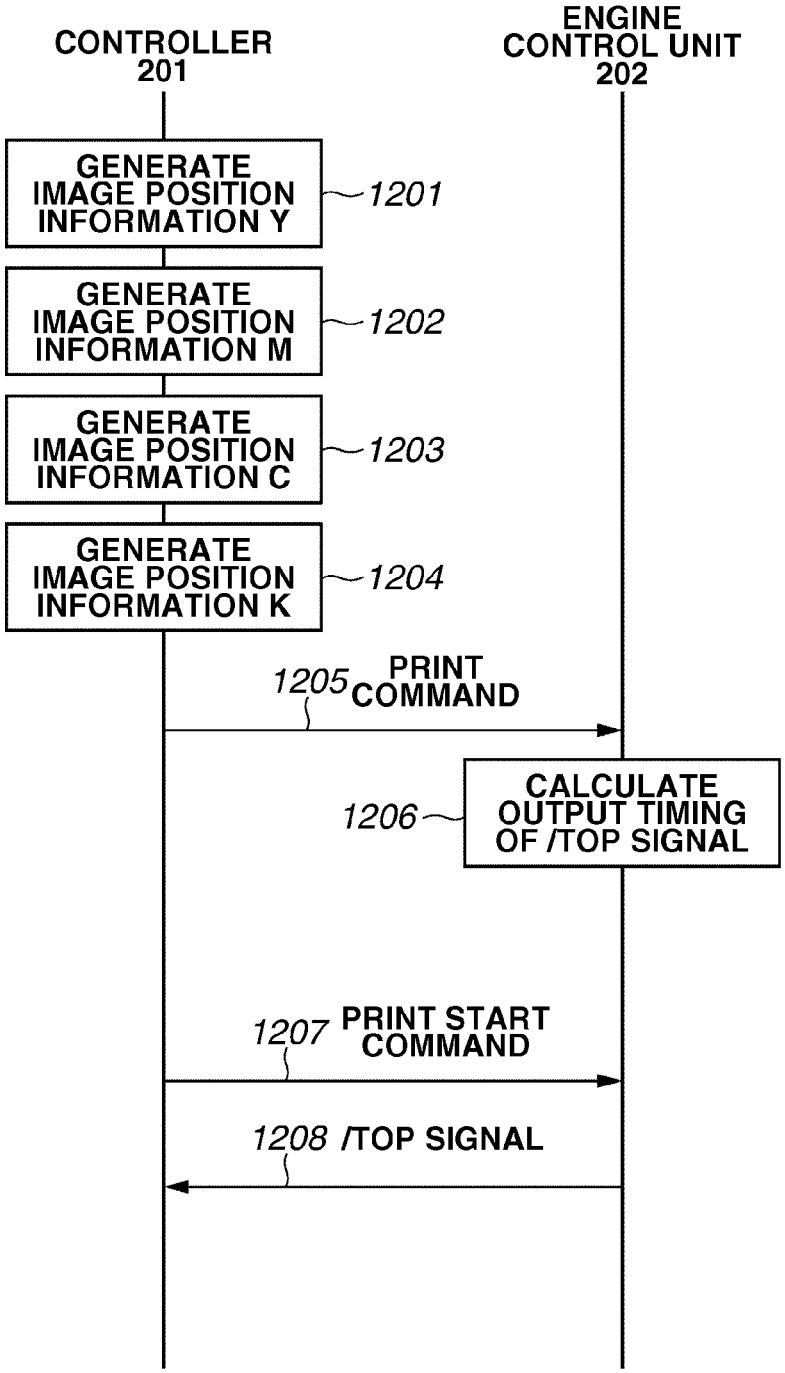
FIG. 12 illustrates a communication sequence between a controller and an engine control unit according to a third exemplary embodiment.

A communication sequence between the controller 201 and the engine control unit 202 according to the present exemplary embodiment will be described with reference to FIG. 12. To form an image by an image forming apparatus, the controller 201 rasterizes image information to generate a plurality of pieces of position information (image position information Y (1201), image position information M (1202), image position information C (1203), and image position information K (1204)) indicating where in the recording medium P to form an image (601).

The controller 201 sends the generated position information to the engine control unit 202 together with the first reservation command (1205).

The engine control unit 202 acquires coordinates where image formation of each color starts from the received reservation command, and calculates a time until the /TOP signal is output based on the size of the margin in leading end portion of each color calculated from the coordinates (1206). A detailed calculation method for calculating a time before the /TOP signal is output will be described below.

Then, with the print start command being sent from the controller 201 to the engine control unit 202 (1207), the engine control unit 202 starts the pre-rotation sequence, and outputs the first /TOP signal in the timing calculated in 1206 (1208).

A calculation method of a /TOP signal forwarded time will be described by using image margin information illustrated in FIG. 13 and a flow chart illustrated in FIG. 14. The flow from the start of image formation to the end thereof in the present exemplary embodiment is a sequence similar to that in FIG. 7, and step S702 in FIG. 7 will be described referring to the flow chart in FIG. 14, omitting the description of other steps.

The engine control unit 202 shifts the timing to output a video signal of each station according to the position where each station is arranged to superpose an image of each color when a color image is formed. The engine control unit 202 outputs a video signal (1321) of Y in synchronization with the /TOP signal (1311). The engine control unit 202 outputs video signals of M, C, and K at video signal output positions 0 obtained by shifting the timing to output the video signal with respect to the /TOP signal (1311) according to the position where each station is arranged.

The video signal output position 0 of each color can be determined from Formulas (6)-(8) shown below.

Video signal output position 0 (*M*) (1331)=conveying distance from the laser irradiation position of 1*st* to the contact point with the intermediate transfer belt 80+conveying distance from the contact point of 1*st* with the intermediate transfer belt 80 to the contact point of 2*st* with the intermediate transfer belt 80−conveying distance from the laser irradiation position of 2*st* to the contact point with the intermediate transfer belt 80 (6)

Video signal output position 0 (*C*) (1341)=conveying distance from the laser irradiation position of 1*st* to the contact point with the intermediate transfer belt 80+conveying distance from the contact point of 1*st* with the intermediate transfer belt 80 to the contact point of 3*st* with the intermediate transfer belt 80−conveying distance from the laser irradiation position of 3*st* to the contact point with the intermediate transfer belt 80 (7)

Video signal output position 0 (*K*) (1351)=conveying distance from the laser irradiation position of 1*st* to the contact point with the intermediate transfer belt 80+conveying distance from the contact point of 1*st* with the intermediate transfer belt 80 to the contact point of 4*st* with the intermediate transfer belt 80−conveying distance from the laser irradiation position of 4*st* to the contact point with the intermediate transfer belt 80 (8)

The engine control unit 202 acquires position information (starting point coordinates (X1, Y1)) of an image for each color (see FIG. 6). The margin in leading end portion of each color can be determined from Formulas (9)-(12) shown below.

Margin in leading end portion (Y) (1322)=conveying direction distance Y1 (Y) (9)

Margin in leading end portion (M) (1332)=conveying direction distance Y1 (M) (10)

Margin in leading end portion (C) (1342)=conveying direction distance Y1 (C) (11)

Margin in leading end portion (K) (1352)=conveying direction distance Y1 (K) (12)

Video signal output positions 1 where video signals of an image portion (excluding the margin) with respect to the /TOP signal (1311) can be determined from Formulas (13)-(16) shown below.

Video signal output position 1 (Y) (1323)=margin in leading end portion (Y) (13)

Video signal output position 1 (*M*) (1333)=margin in leading end portion (*M*)+video signal output position 0 (*M*) (14)

Video signal output position 1 (*C*) (1343)=margin in leading end portion (*C*)+video signal output position 0 (*C*) (15)

Video signal output position 1 (*M*) (1353)=margin in leading end portion (*K*)+video signal output position 0 (*M*) (16)

Figure 14:
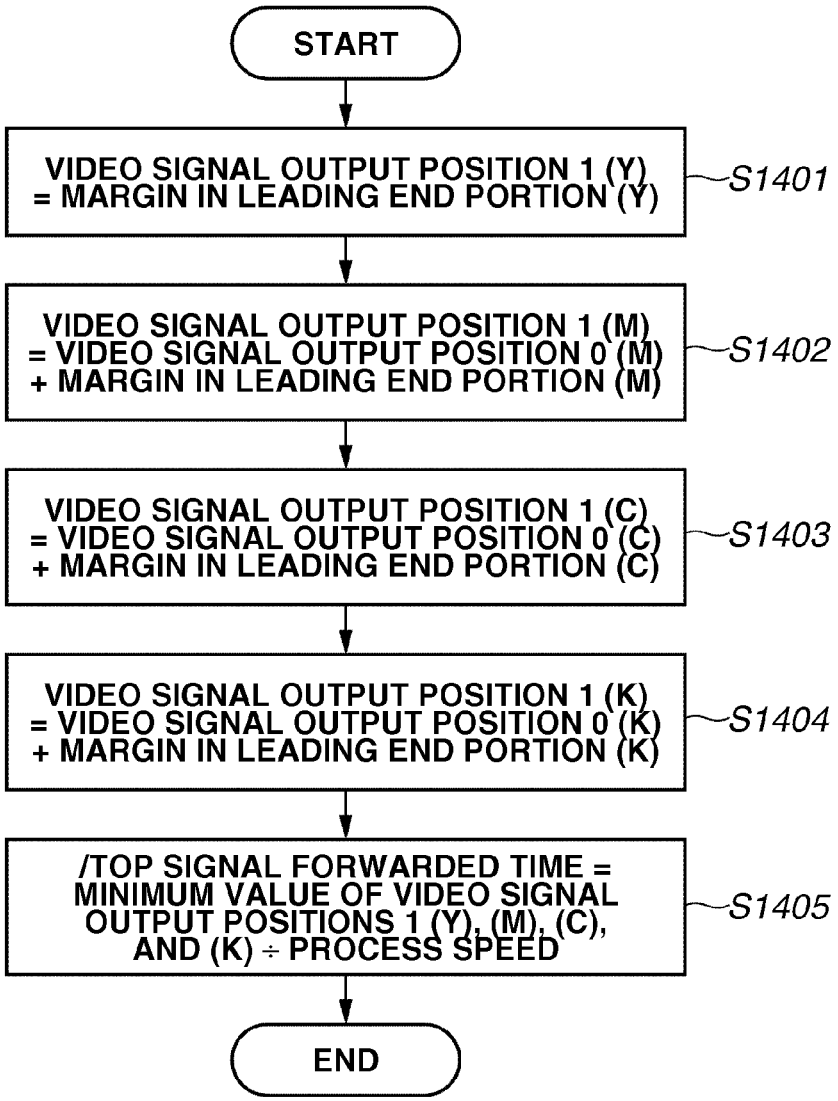
FIG. 14 is a flow chart illustrating a calculation method of a /TOP signal reduced time according to the third exemplary embodiment.

In steps S1401, S1402, S1403, and S1404 in FIG. 14, the video signal output position 1 (Y), the video signal output position 1 (M), the video signal output position 1 (C), and the video signal output position 1 (K) are calculated by using Formulas (13), (14), (15), and (16), respectively.

Normally, when the /TOP signal (1311) is output, it is necessary for the engine control unit 202 to be ready for image formation. However, if the fact is considered that a margin portion does not require image formation by toner, it follows that the engine control unit 202 needs to be ready for image formation by the timing of starting the earliest image formation among the video signal output position 1 (Y) (1323), the video signal output position 1 (M) (1333), the video signal output position 1 (C) (1343), and the video signal output position 1 (K) (1353).

In the flowchart in FIG. 14, the start timing of image formation of the station that starts the image formation earliest is determined. From this result, a time that the /TOP signal can be moved forward can be determined.

Figure 13:
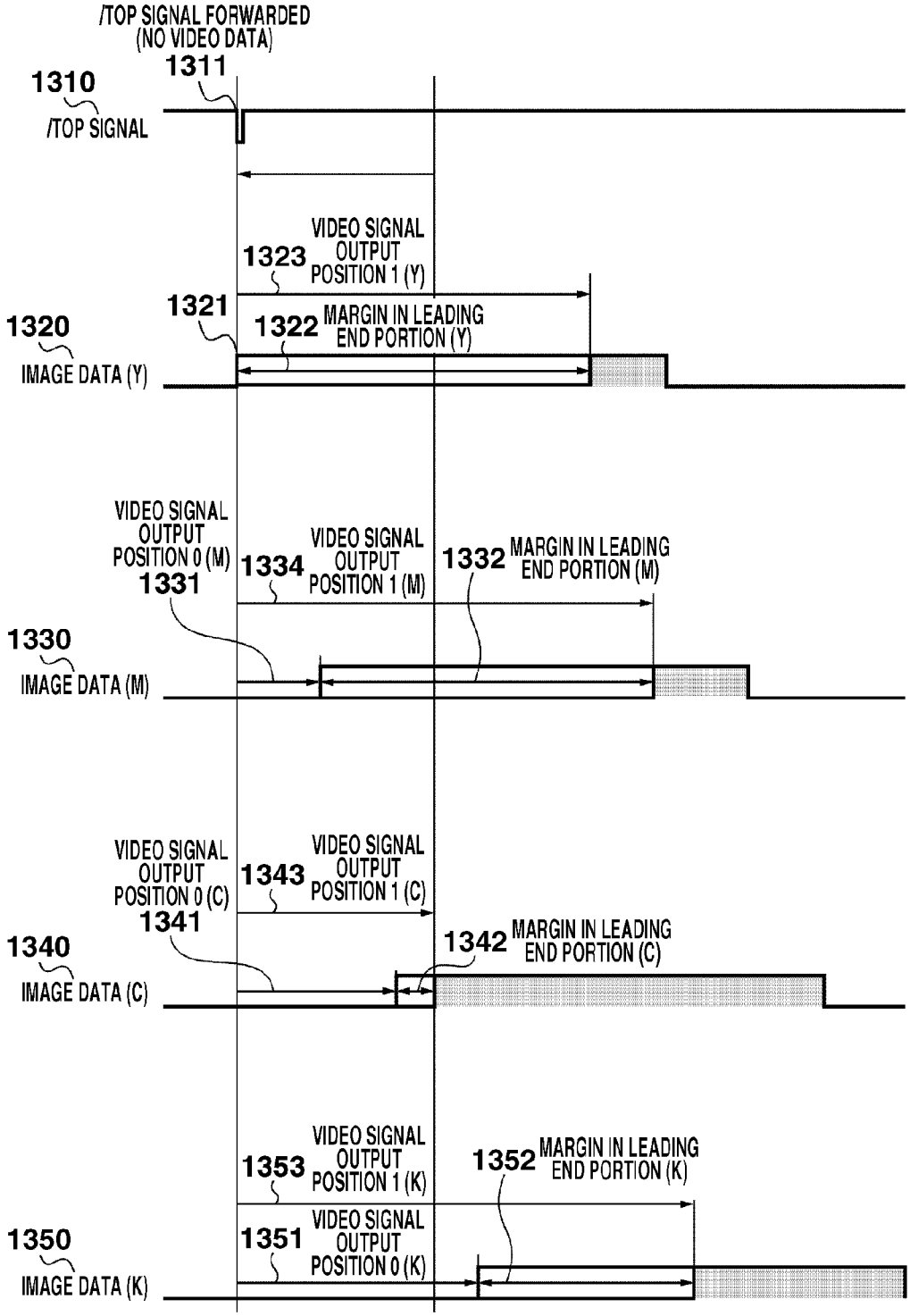
FIG. 13 illustrates a write start position of the image according to the third exemplary embodiment.

In the example illustrated in FIG. 13, the engine control unit 202 can move forward the sending timing of the /TOP signal by a time of the minimum video signal output position 1 (C) (1343). More specifically, the forwarded timing of the /TOP signal can be determined from Formula (17) shown below.

/*TOP* signal forwarded time=minimum video signal output position 1/printing speed (17)

In step S1405 in FIG. 14, the /TOP signal forwarded time is calculated from Formula (17). It is assumed that, for example, that the printing speed is 115.5 mm/sec, margin in leading end portion=20 mm, margin in leading end portion (Y)=200 mm, margin in leading end portion (M)=150 mm, margin in leading end portion (C)=30 mm, and margin in leading end portion (K)=20 mm. It is also assumed that the conveying distance from the laser irradiation position of 1*st* to the contact point with the intermediate transfer belt 80=36.1 mm, conveying distance from the laser irradiation position of 2*st* to the contact point with the intermediate transfer belt 80=36.1 mm, conveying distance from the laser irradiation position of 3*st* to the contact point with the intermediate transfer belt 80=36.1 mm, and conveying distance from the laser irradiation position of 4*st* to the contact point with the intermediate transfer belt 80=36.1 mm. It is also assumed that the conveying distance from the contact point of 1*st* with the intermediate transfer belt 80 to the contact point of 2*st* with the intermediate transfer belt 80=78 mm, conveying distance from the contact point of 1*st* with the intermediate transfer belt 80 to the contact point of 3*st* with the intermediate transfer belt 80=156 mm, and conveying distance from the contact point of 1*st* with the intermediate transfer belt 80 to the contact point of 4*st* with the intermediate transfer belt 80=234 mm.

Under these conditions, the flow chart in FIG. 14 is executed. In step S1401, the engine control unit 202 determines the video signal output position 1 (Y)=200 mm from Formulas (9) and (13). In step S1402, the engine control unit 202 determines the video signal output position 1 (M)=(36.1 mm+78 mm−36.1 mm)+150 mm=238 mm from Formulas (6), (10), and (14).

In step S1403, the engine control unit 202 determines the video signal output position 1 (C)=(36.1 mm+156 mm−36.1 mm)+30 mm=186 mm from Formulas (7), (11), and (15). In step S1404, the engine control unit 202 determines the video signal output position 1 (K)=(36.1 mm+234 mm−36.1 mm)+20 mm=254 mm from Formulas (8), (12), and (16). From results calculated in steps S1401 to S1404, the video signal output position 1 (C) is determined to start image formation earliest.

In step S1405, the engine control unit 202 determines the /TOP signal forwarded time=186 mm÷115.5 mm/s=1610 ms from the video signal output position 1 (C) determined to start image formation earliest and Formula (17). If the time after the start of the pre-rotation sequence before a normal /TOP signal is ready to be output is 4743 ms, the /TOP signal can be output in 4743−1610=3133 ms from the above Formula (17). Accordingly, the image formation time is reduced by 1610 ms.

Thus, by sending the /TOP signal in time for the color for which image formation is started earliest based on a margin in leading end portion of an image for each color to be formed, the time until the image formation is completed can further be reduced compared with a case where the /TOP signal is sent in time for an image formed after each color being superposed.

In the present exemplary embodiment, a case where position information of an image formed simultaneously with the reservation command is sent has been described, the present exemplary embodiment is not limited to this. For example, a special command to send position information of an image may be used to send the position information in the timing before or after the reservation command or the transmission timing to send position information together with the print start command may be adopted.

Also in the present exemplary embodiment, the control to send the /TOP signal in time for the color whose image is formed earliest has been described, but if the /TOP signal can be issued for each of a plurality of colors, the /TOP signal can be sent in time for the rendering timing of each color calculated above.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-283462 filed Dec. 14, 2009, which is hereby incorporated by reference herein in its entirety.

What is claimed is:

1. An image forming apparatus comprising:

an image forming unit configured to form an image; and a control unit configured to control timing to send a signal to request image information for causing the image forming unit to form an image, wherein the control unit controls the timing to send the signal to request the image information according to information on a margin from a leading end of a recording medium to a leading end of the image formed on the recording medium in a conveying direction of the recording medium so that the timing to send the signal to request the image information is earlier than timing to request predetermined image information after preparation for forming an image is completed.

2. An image forming apparatus according to claim 1, wherein the control unit is configured to receive position information on the image to be formed by the image forming unit and obtain the information on the margin according to the position information of the image.

3. An image forming apparatus according to claim 1, wherein the image forming unit includes a plurality of image bearing members and a plurality of developing units configured to develop an image of a plurality of colors on the plurality of image bearing members, and wherein the control unit controls the timing to send the signal to request the image information based on information on a margin of a color with a shortest length of a margin area in the conveying direction of the recording medium.

4. An image forming apparatus according to claim 3, wherein the control unit controls, based on information on a margin of a color with a latest timing to finish rendering a trailing end of the image to be formed on the recording medium in the conveying direction of the recording medium, an operation to stop the plurality of image bearing members and the plurality of developing units so that the operation starts.

5. The image forming apparatus according to claim 1, wherein the control unit controls timing to start conveying a recording medium based on the timing to send the signal to request the image information.

6. An image forming apparatus comprising:

an image forming unit configured to form an image; and a control unit configured control timing to send a signal to request image information for causing the image forming unit to form an image, wherein the image forming unit includes a plurality of image bearing members and a plurality of developing units configured to develop an image of a plurality of colors on the plurality of image bearing members, and wherein the control unit controls the timing to send the signal to request the image information according to information on a margin from a leading end of a recording medium to a leading end of the image formed on the recording medium in a conveying direction of the recording medium so that the timing to send the signal to request the image information is earlier than timing to request predetermined image information after preparation for forming an image is completed.

* * * * *